US005931442A

United States Patent [19]

Cummins

[11] Patent Number: 5,931,442

[45] Date of Patent: Aug. 3, 1999

[54] SUBMERSIBLE WORK VESSEL FOR INSTALLING A BLOW OUT PREVENTER

[75] Inventor: Emmette L. Cummins, Baton Rouge, La.

[73] Assignee: Cumpac, Inc., Baton Rouge, La.

[21] Appl. No.: 08/971,161

[22] Filed: Nov. 14, 1997

[51] Int. Cl.[6] ..... E21B 33/064

[52] U.S. Cl. ..... 251/1.1; 166/55.2; 166/55.6; 166/298; 251/1.3

[58] Field of Search ..... 166/55, 55.2, 55.6, 166/297, 298; 251/1.1, 1.3; 405/188, 192; 114/312, 313, 314; 137/318

[56] References Cited

U.S. PATENT DOCUMENTS

| | | | |
|---|---|---|---|
| 207,469 | 8/1878 | Wolf . | |
| 341,365 | 5/1886 | Wilson . | |
| 727,632 | 5/1903 | Hosford . | |
| 736,446 | 8/1903 | Schlickeysen . | |
| 775,686 | 11/1904 | Smith . | |
| 1,043,113 | 11/1912 | Krupp . | |
| 1,127,816 | 2/1915 | Sink . | |
| 1,160,572 | 11/1915 | Bunnell . | |
| 1,217,837 | 2/1917 | Scanlin . | |
| 1,451,479 | 4/1923 | Smith . | |
| 1,874,889 | 8/1932 | Burris . | |
| 1,949,672 | 3/1934 | Barrier | 166/15 |
| 2,120,114 | 6/1938 | Patton | 29/67 |
| 2,129,969 | 9/1938 | Showalter | 29/67 |
| 2,622,837 | 12/1952 | Goodman | 251/5 |
| 2,667,751 | 2/1954 | Osborn | 405/188 |
| 2,709,860 | 6/1955 | Helton | 37/191 |
| 2,919,111 | 12/1959 | Nicholson | 255/1.8 |
| 3,277,964 | 10/1966 | Houpeurt et al. | 166/35 |
| 3,408,034 | 10/1968 | Lau | 251/9 |
| 3,561,526 | 2/1971 | Williams et al. | 166/55 |
| 3,603,387 | 9/1971 | Schoeffler | 166/55 |
| 3,716,068 | 2/1973 | Addison | 251/1.3 |
| 3,740,017 | 6/1973 | Pogonowski | 251/5 |
| 3,741,517 | 6/1973 | Pogonowski | 251/5 |
| 3,766,979 | 10/1973 | Petrick | 166/55 |
| 3,789,689 | 2/1974 | Mace | 72/407 |
| 4,140,041 | 2/1979 | Frelau | 89/1 B |
| 4,163,477 | 8/1979 | Johnson et al. | 166/362 |
| 4,285,629 | 8/1981 | Elliston | 414/740 |
| 4,347,898 | 9/1982 | Jones | 251/1.3 |
| 4,614,034 | 9/1986 | Russell, Jr. | 30/120 |
| 4,620,819 | 11/1986 | Marsland et al. | 114/312 |
| 4,923,005 | 5/1990 | Laky et al. | 166/55 |
| 4,923,008 | 5/1990 | Wachowicz et al. | 166/250 |
| 5,199,493 | 4/1993 | Sodder, Jr. | 166/297 |
| 5,509,440 | 4/1996 | Cantaloube et al. | 137/318 |

FOREIGN PATENT DOCUMENTS

| | | | |
|---|---|---|---|
| 642293 | 6/1962 | Canada | 405/188 |
| 1318003 | 1/1962 | France . | |

*Primary Examiner*—Sherman Basinger
*Attorney, Agent, or Firm*—Roy, Kiesel & Tucker, PLC

[57] ABSTRACT

A submersible work vessel and a method of using the same are disclosed. The vessel contains an internal work space. It also contains a set of openable jaws that are designed to engage an underwater pipe. When the pipe is engaged, it will pass through the internal work space of the submersible work vessel. When the jaws have engaged the pipe, the internal work space should be substantially watertight, at which point the water in internal work space may be pumped out. When the water has been substantially evacuated, a worker may enter the internal work space and work on the pipe. One of the principal tasks the work vessel is designed to facilitate is the installation of a blow out preventer. The worker will install the blow out preventer on the pipe. The blow out preventer is designed to remove a section of the pipe and then to seal the severed pipe. This is preferably done with a cutter mounted on a hydraulic arm and a sealing block also mounted on a hydraulic arm. Positioning the sealing block over the severed pipe will cut off flow through the pipe. When the restoration of flow is desired, the block may be removed, allowing the blow out preventer to function as a valve.

17 Claims, 13 Drawing Sheets

SUBMERSIBLE WORK VESSEL FOR INSTALLING A BLOW OUT PREVENTER

BACKGROUND OF THE INVENTION

In platform offshore petroleum production, the petroleum usually travels from the formation to the platform in a production line. Between the floor of the ocean or lake and the platform the production line is generally encased in one or more concentric casing pipes. The space between these casings and the production line is filled with concrete or grout to provide strength. Access to the production line between the platform and the bottom is thus prevented.

This lack of access can prove to be problematic in the event of a blow out. In a blow out, control of the petroleum exiting the well is lost. Such loss of control may result in the loss of a large quantity of petroleum, which may ignite. The fires resulting from such blow outs can be quite ferocious because of the enormous amount of fuel being fed to the fire by the well. The heat generated by these fires can prevent, or greatly inhibit, approach of the platform or portions thereof by firefighters. The fires may also render on deck blow out preventers inaccessible or inoperable if such preventers are in place. Unless the well has a remotely operable blow out preventer installed in the production line, shutting off the flow of petroleum, and thus getting control of the fire, may be inhibited by the previously described casing.

Therefore, an invention meeting the following objectives is desired.

OBJECTS OF THE INVENTION

It is an object of the invention to provide access to underwater pipe

It is another object of the invention to provide access to underwater casing.

It is another object of the invention to provided access to an underwater production line.

It is still another object of the invention to create a work space surrounding the underwater casing.

It is still another object of the invention to facilitate the installation of a blow out preventer in the production line.

It is still another object to cut off the flow of petroleum in the production line.

It is yet another object to be able to restore the flow of petroleum in the production line once flow has been terminated.

SUMMARY OF THE INVENTION

The invention comprises a blow out preventer for closing a production line in a petroleum well or other pressurized pipe. The blow out preventer has a housing which attaches to the production line. The attachment between the housing must be able to withstand the pressures within the production line without failing and without leaking substantially. Furthermore, the housing itself must be able to withstand those same pressures without failing. Within the housing is a first hydraulic arm. This arm will advance a pair of wedges or saws or other cutting means into the production line, severing it in two places, thereby removing a section of the pipe. Alternately, the cutting means may only score the production line, preparing a section for removal.

A second hydraulic arm will be positioned within the housing. This second arm will advance a block into the void left in the production line. In the embodiment where the production line has only been scored, extension of the block with the second hydraulic arm will remove a section of the production line, creating the void. In both cases, the block is vertically slidable. When the second hydraulic arm is extended, the block will engage the ceiling of the housing over the severed production line, closing the line and preventing further flow to the surface. Alternatively, the block may be positioned between the cutting means and the first hydraulic arm. Again, the block should be vertically slidable. When the production line has been severed, the first hydraulic arm will advance the block into the void left in the production line. The block will engage the production line just as in the previously described embodiments. When it is desired to reopen the line, the block may be retracted with the first or second hydraulic arm, depending upon the embodiment.

The inventor contemplates installing the blow out preventer in offshore applications using a submersible work vessel. The work vessel has a set of jaws sized to engage the casing surrounding the production line. The vessel will create a watertight seal with the production line with its jaws. When the jaws are closed, the space within the jaws will create an internal work space, encircling the production line. The vessel contains a pump for evacuating the water within the internal work space.

Once the water has been removed from the internal work space, a worker may enter to install the blow out preventer. The first step will usually be to remove the casing and grout surrounding the production line. The casing can be removed with a torch or a saw. The grout can be removed with a pick or other similar instrument after the casing has been removed.

DESCRIPTION OF THE PREFERRED EMBODIMENT OF THE INVENTION

Figure 1:
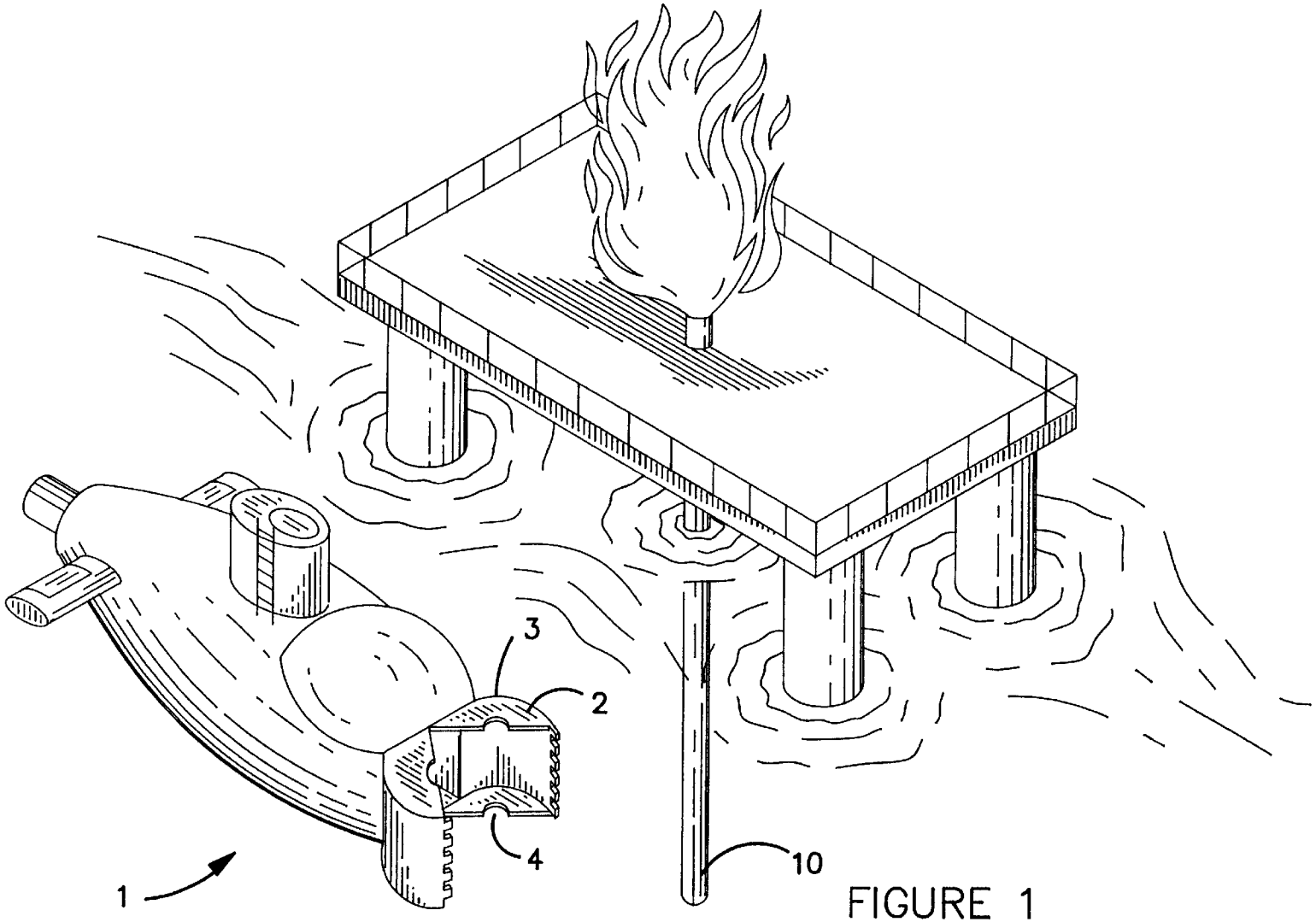
FIG. 1 is a perspective view of a self-propelled submersible work vessel approaching the casing surrounding the production line in an out of control petroleum platform.

FIG. 1 shows a self propelled embodiment of the submersible work vessel 1. Although a self-propelled version is illustrated, it should be understood that submersible work vessel 1 may be dumb. Other embodiments may include a submersible work vessel 1 that is pushed into position by a surface or subsurface vessel. Alternatively, submersible work vessel 1 may be attached to an extension of another vessel which may be designed for surface or subsurface travel.

Submersible work vessel 1 is equipped with jaws 2 which are configured to engage piping. Jaws 2 have an open position and a closed position. FIG. 1 depicts jaws 2 in the open position. While FIG. 1 shows both jaws 2 to be capable of motion, it should be understood that only one jaw 2 must move. Furthermore, jaws 2 may be comprised of more than two jaw members 3.

Jaw members 3 should contain a casing indentation 4. Casing indentations 4 should be aligned with one another so that upon the closing of jaws 2, casing indentations 4 form apertures 5. Apertures 5 may be sized to engage casing. Alternatively, apertures 5 may be designed to receive interchangeable fittings 6 whose internal diameter will vary so that casing or pipes of differing diameter may be engaged using a single set of jaws 2. Apertures 5 and, in a preferred embodiment, fittings 6 will allow jaws 2 to engage casing or piping.

Submersible work vessel 1 should have an interior work space 7. When jaws 2 are in the open position they provide access to the interior of work space 7. When jaws 2 are in the closed position and have engaged a pipe or pipe casing, apertures 5 should be positioned to allow the casing to pass through the interior of work space 7.

Interior work space 7 should preferably be substantially water tight when jaws 2 are in the closed position and have engaged a pipe or pipe casing. To this end, the seam between jaws 2 should be watertight in the closed position. Jaws 2 should also be fitted with a means for creating a substantially watertight seal 8 between jaws 2 and the pipe. Such sealing means 8 may be a pneumatic seal or other equivalent devices. The surface of the pipe will often be uneven because of barnacle growth or corrosion. To facilitate the formation of a seal under these conditions, it may be beneficial to coat the interior surface of sealing means 8 with silicone gel or other similar substance.

Figure 3:
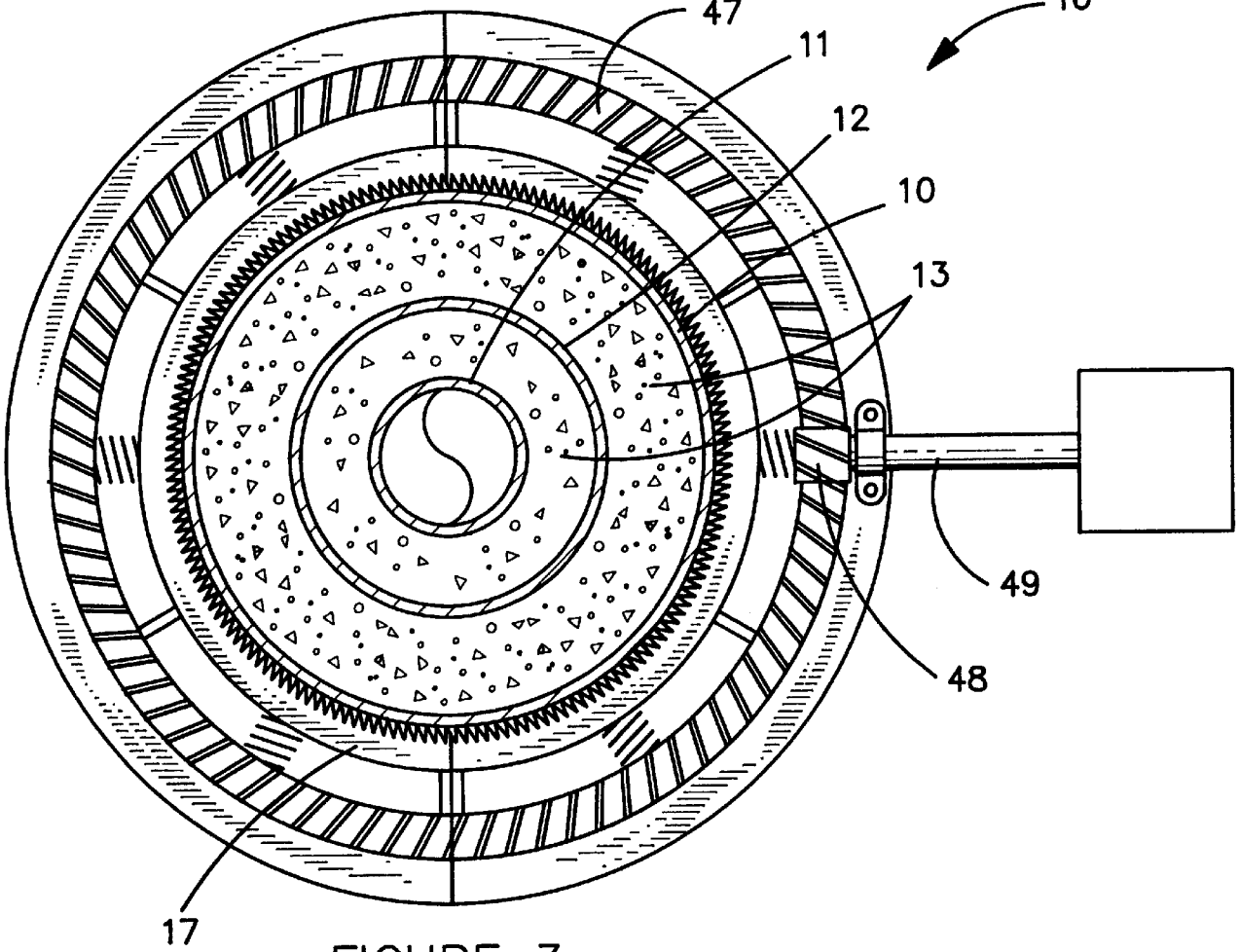
FIG. 3 is a top view of a rotatable fitting containing scouring surfaces attached to a casing shown in cut-away.
Figure 4A:
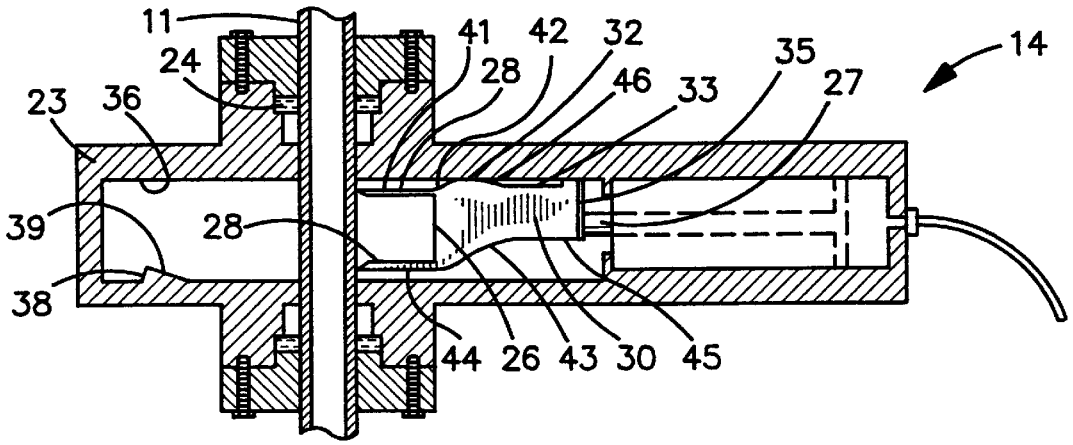
FIG. 4A is a cross-sectional view of a blow out preventer having one hydraulic arm, a pair of shears, and a block, positioned on a production line prior to severance.
Figure 4B:
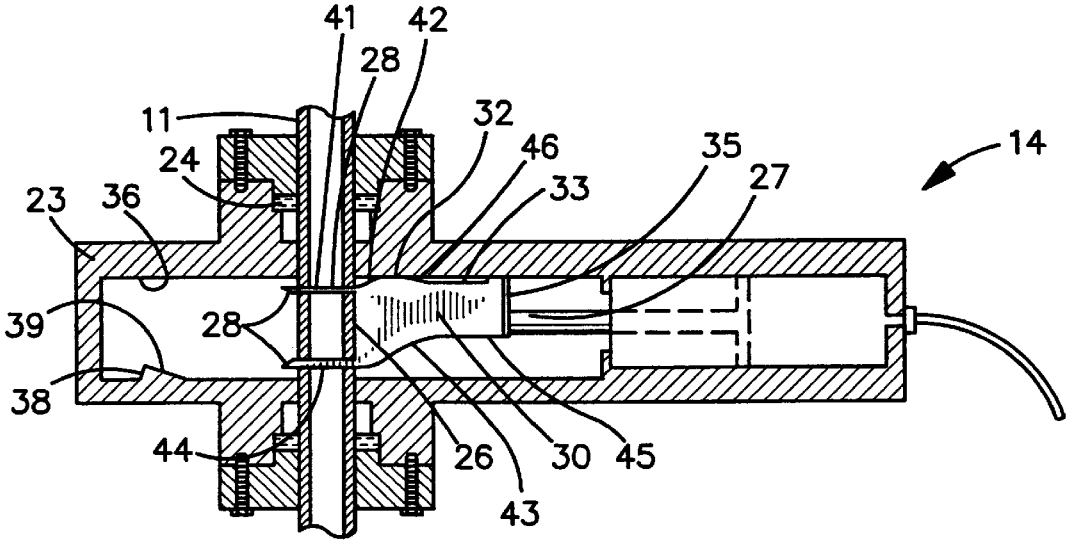
FIG. 4B is a cross-sectional view of a blow out preventer having one hydraulic arm, a pair of shears, and a block, positioned on a production line during severance.
Figure 4C:
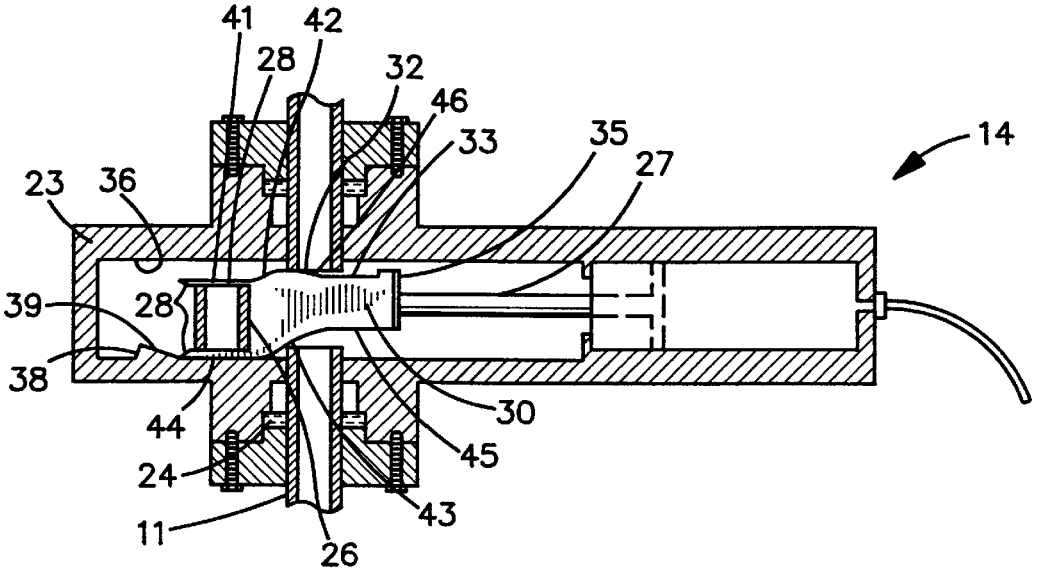
FIG. 4C is a cross-sectional view of a blow out preventer having one hydraulic arm, a pair of shears, and a block, positioned on a production line, after severance of the production line during closure of the production line.
Figure 4D:
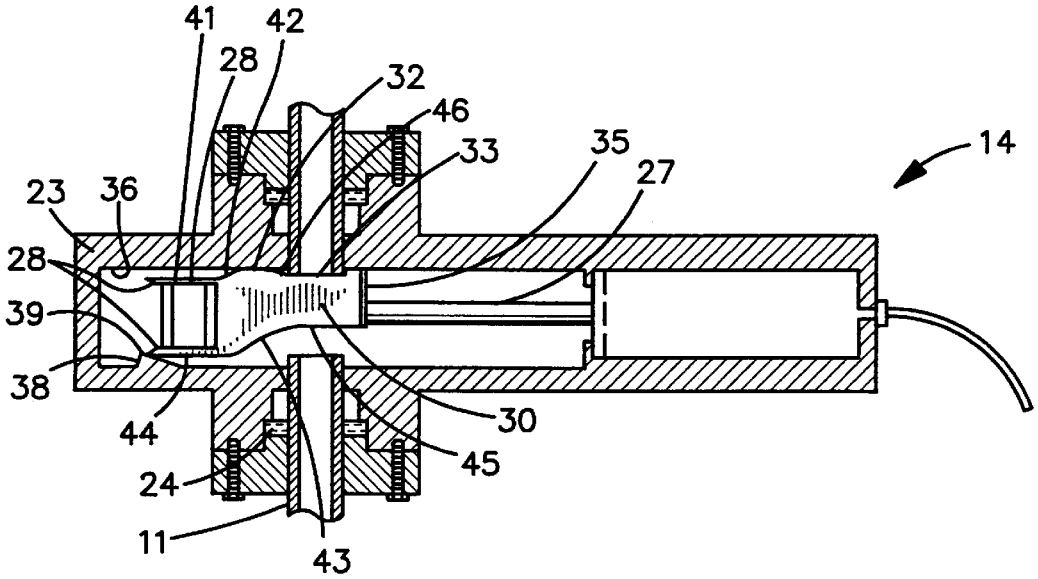
FIG. 4D is a cross-sectional view of a blow out preventer having one hydraulic arm, a pair of shears, and a block, positioned on a production line, with the production line closed by the block.

Another preferred method of facilitating the formation of a seal between the surface of the pipe or casing and jaw members 3 is to provide jaw members 3 with a casing scrubbing means 16. Casing scrubbing means 16 comprises a rotatable abrasive surface 17. Upon the closure of jaws 2, casing scrubbing means will be circumferentially positioned about the casing. Rotatable abrasive surface 17 will then scour the casing by rotating about it. The result will be a substantially smooth casing surface which will facilitate the formation of a water tight seal. The inventor contemplates effecting rotation of abrasive surface 17 by affixing it to a ring gear 47 in a configuration such as the one illustrated in FIG. 3. Ring gear 47 will then be rotated with a gear 48 on a shaft 49 or by other conventional means.

Upon the completion of the scouring of the casing surface, casing scrubbing means 16 will be replaced with sealing means 8. This may be done by positioning sealing means 8 and scrubbing means 16 in a slidable relationship with one another within fitting 6. Thus, sealing means 8 may be moved to occupy the position over the casing previously occupied by scrubbing means 16. Alternatively, jaw members 3 may release the casing and be moved to position sealing means 8 over the cleaned surface of the casing.

In another preferred embodiment (not shown), sealing means 8 and scrubbing means 16 are configured in an alternating arrangement within fitting 6. One embodiment of such a device would include an inner surface and an outer surface. The inner surface would include one or more abrasive surfaces 17. Between each set of abrasive surfaces 17 would be a pneumatic seal. Abrasive surfaces 17 would preferably be wider than the pneumatic seals. The inner surface would be rotatable relative to the outer surface and would also be vertically slidable relative to the outer surface. Upon completion of scrubbing, the inner surface would slide vertically relative to the outer surface to place the pneumatic seals over the cleaned portions of the casing. The pneumatic seals would then be pressurized to provide a substantially watertight seal with the casing.

Figure 2:
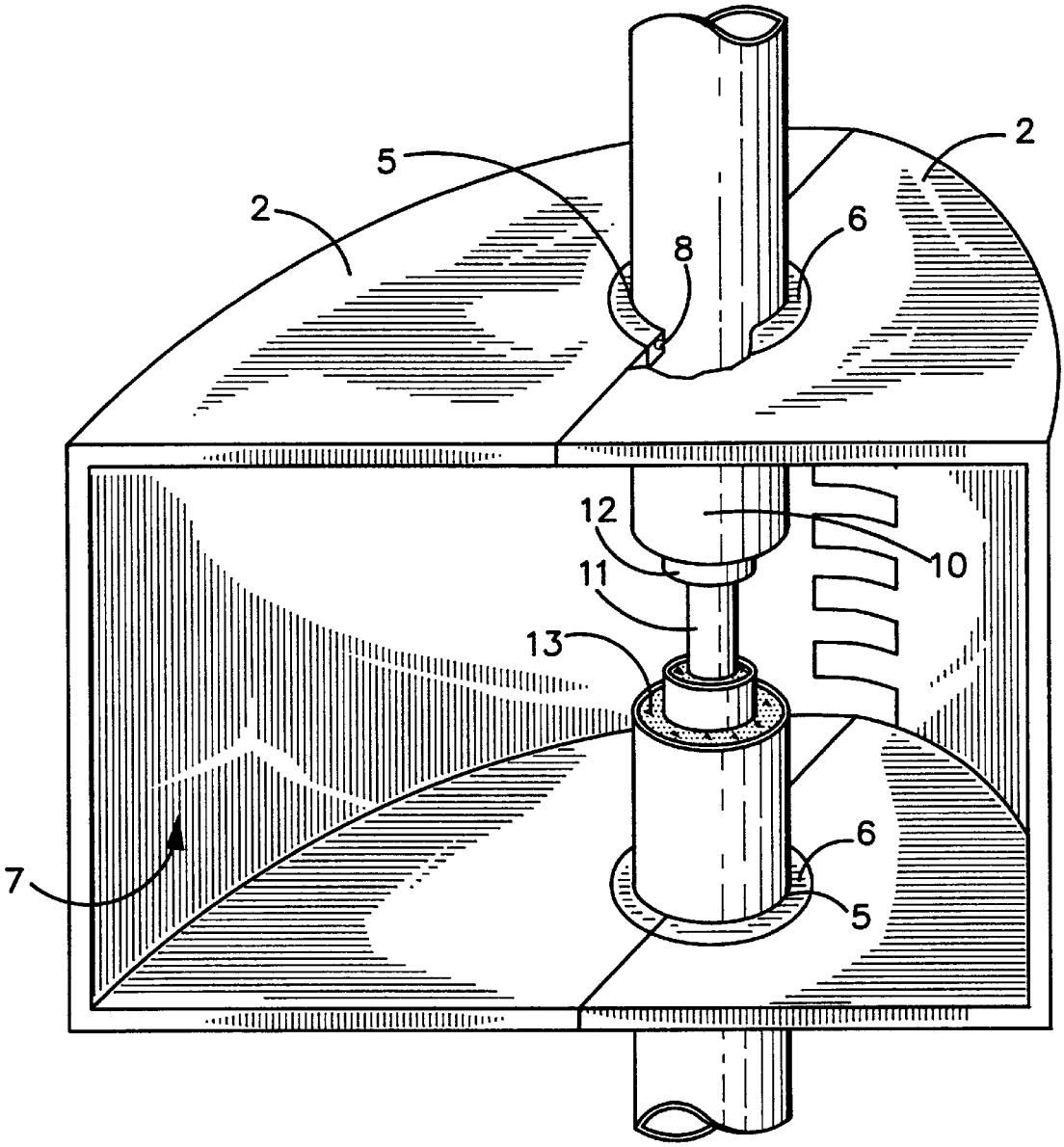
FIG. 2 is a cut-away, perspective view showing the interior work space of the submersible work vessel when the vessel is engaged with casing surrounding the exposed production line of an oil platform.

FIG. 2 depicts the interior of work space 7 after jaws 2 have engaged a casing. In FIG. 2, the casing shown is an outer casing 10 containing a production line 11. Between outer casing 10 and production line 11 is an inner casing 12. Concrete or grout 13 fills the space between production line 11 and inner casing 12 and the space between inner casing 12 and outer casing 10. Outer casing 10, inner casing 12 and grout 13 have been removed to allow access to production line 11. In this situation it may be preferable to connect the upper and lower portions of the severed outer casings 10 with a support cage (not shown) in order that the weight of the casing may be supported during operations. The use of a support cage is expected to be particularly useful when the invention is used on wells operating in deeper water. It is anticipated that a support cage comprised of one or more steel connecting rods welded to the casing prior to severance will be sufficient. When the support cage is used, the rods comprising the cage should be configured to provide adequate work space around the severed section of the pipe to perform the tasks discussed below. This may be accomplished by arranging the support cage in a spherical or cubical shape.

Submersible work vessel 1 should contain a means for evacuating water from interior work space 7. Such evacuation means may be a pump or other equivalent device. Evacuation means may also be used to remove any water that may leak into interior work space 7 while submersible work vessel 1 is engaged with the pipe.

After the water has been evacuated from interior work space 7, a worker may enter. This may be accomplished through a means for providing human access to interior work space 7. Access means may be a hatch, a port or a door or any other equivalent passage. Access means should preferably be watertight. In a preferred embodiment, work vessel 1 has at least three spaces including interior work space 7. Each space should be separated from the others by separately operable and watertight access means. Each should also preferably have separate water evacuation means. The provision of three separate spaces will allow divers to enter interior work space 7 from work vessel 1 when interior work space 7 is flooded, if necessary.

Once inside interior work space 7, a worker may begin working on the pipe. Where the pipe is encased in an outer casing 10 and grout 13, these should be removed to allow access to the pipe. Where the pipe is production line 11 and the object is to close production line 11, the worker will install blow out preventer 14 on production line 11.

Figure 5A:
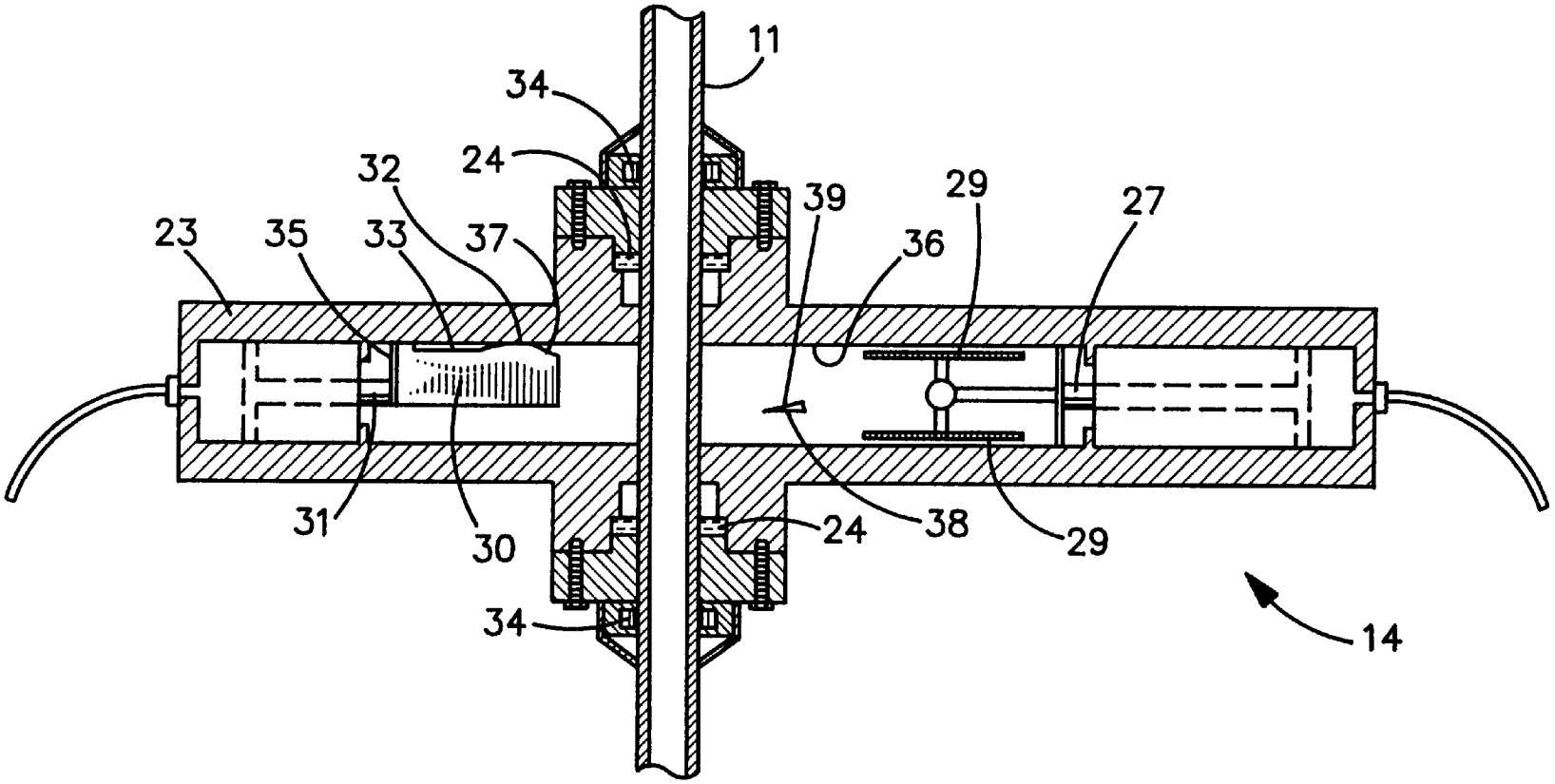
FIG. 5A is a cross-sectional view of a blow out preventer having two hydraulic arms, a pair of rotatable saws, and a block on a production line prior to severance.
Figure 5B:
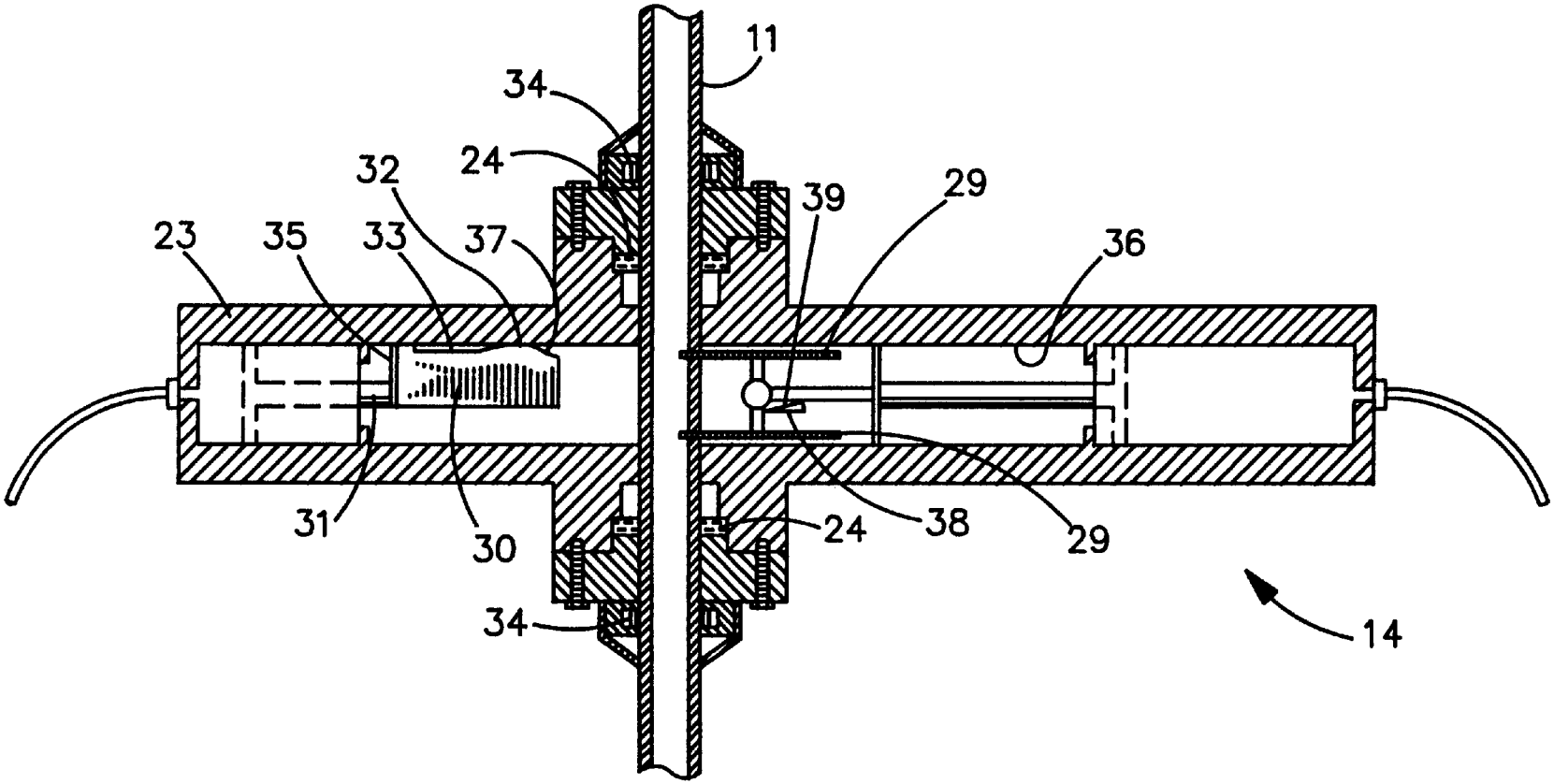
FIG. 5B is a cross-sectional view of a blow out preventer having two hydraulic arms, a pair of rotatable saws, and a block on a production line during severance.
Figure 5C:
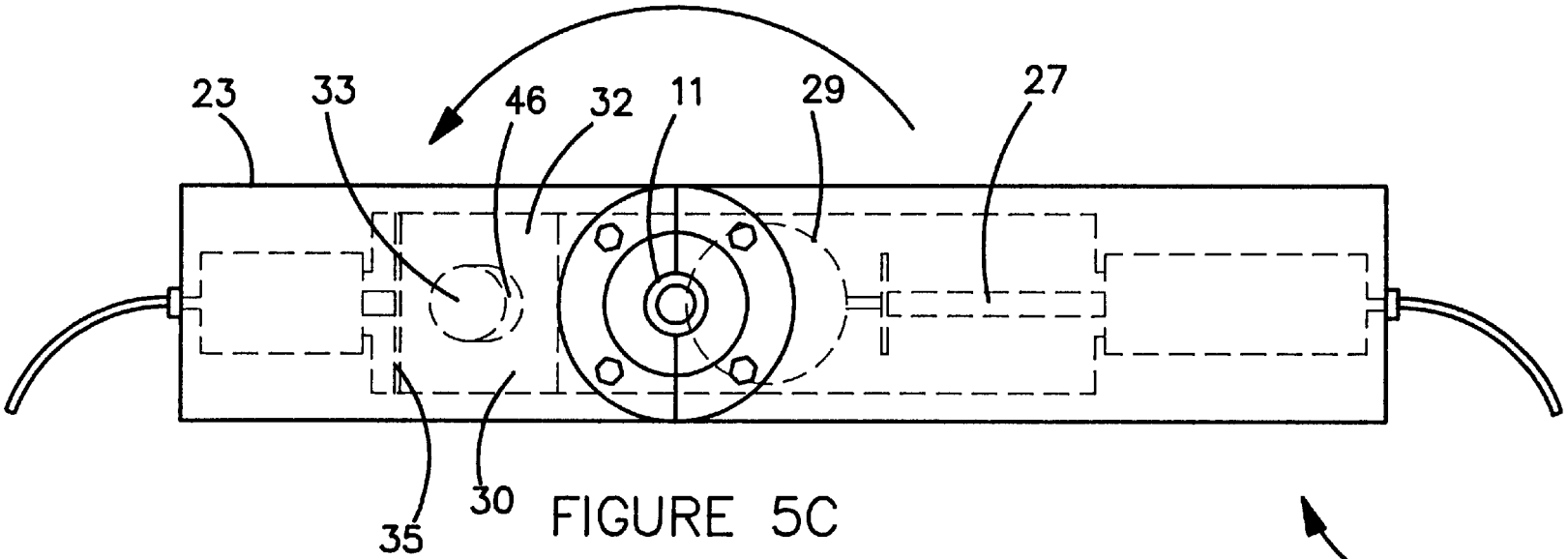
FIG. 5C is a top view of a blow out preventer having two hydraulic arms, a pair of rotatable saws, and a block on a production line during severance, illustrating the rotation of the saws around the production line.
Figure 7:
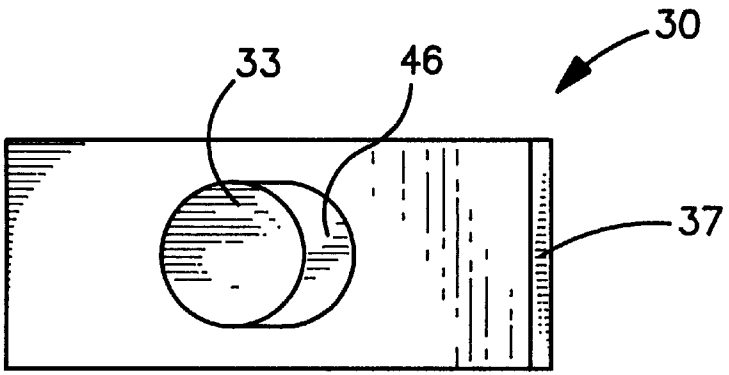
FIG. 7 is a perspective view of a block showing a preferred indentation in the upper surface of the block.
Figure 5D:
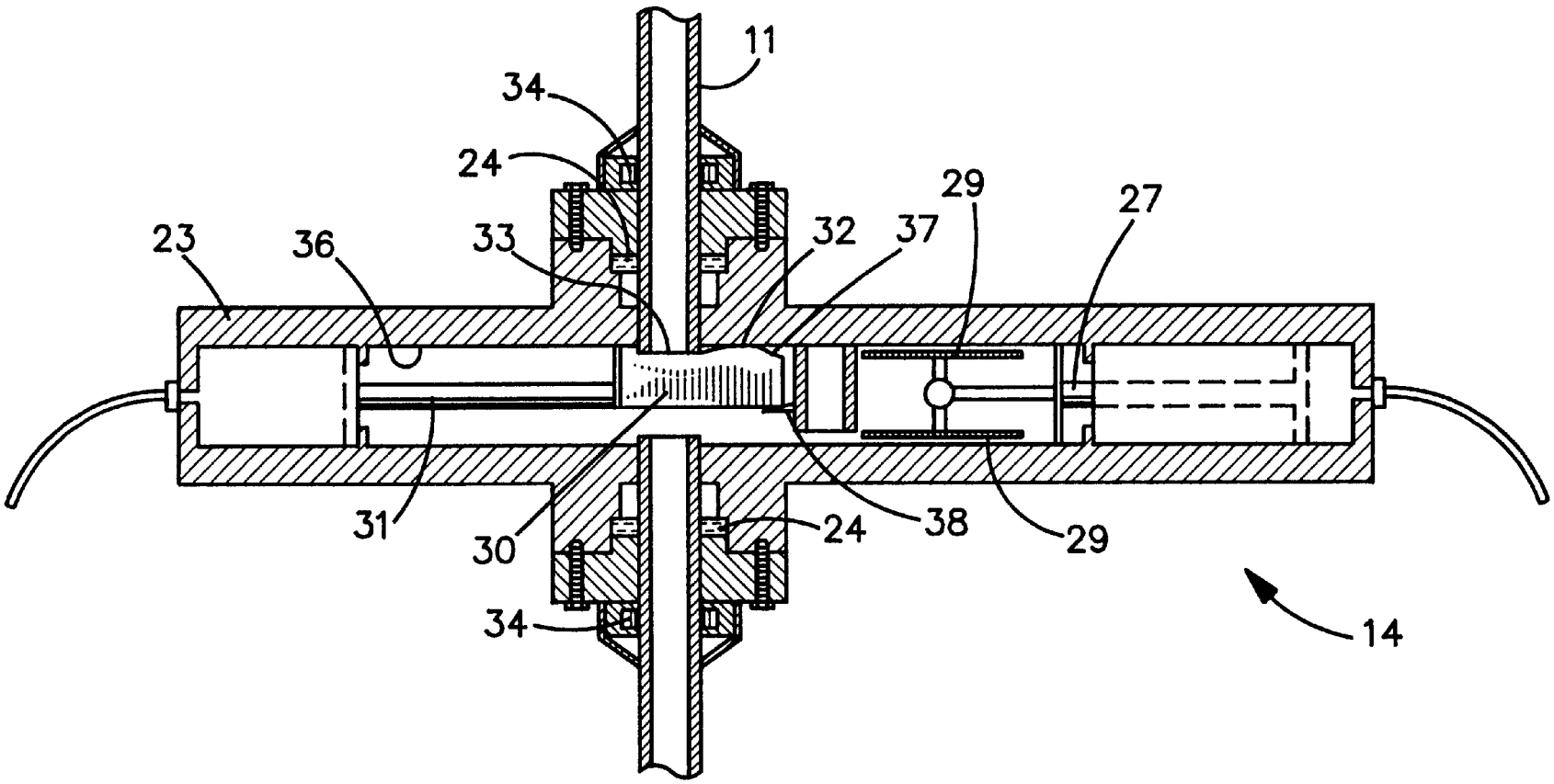
FIG. 5D is a cross-sectional view of a blow out preventer having two hydraulic arms, a pair of rotatable saws, and a block on a production line with the production line closed by the block.
Figure 6A:
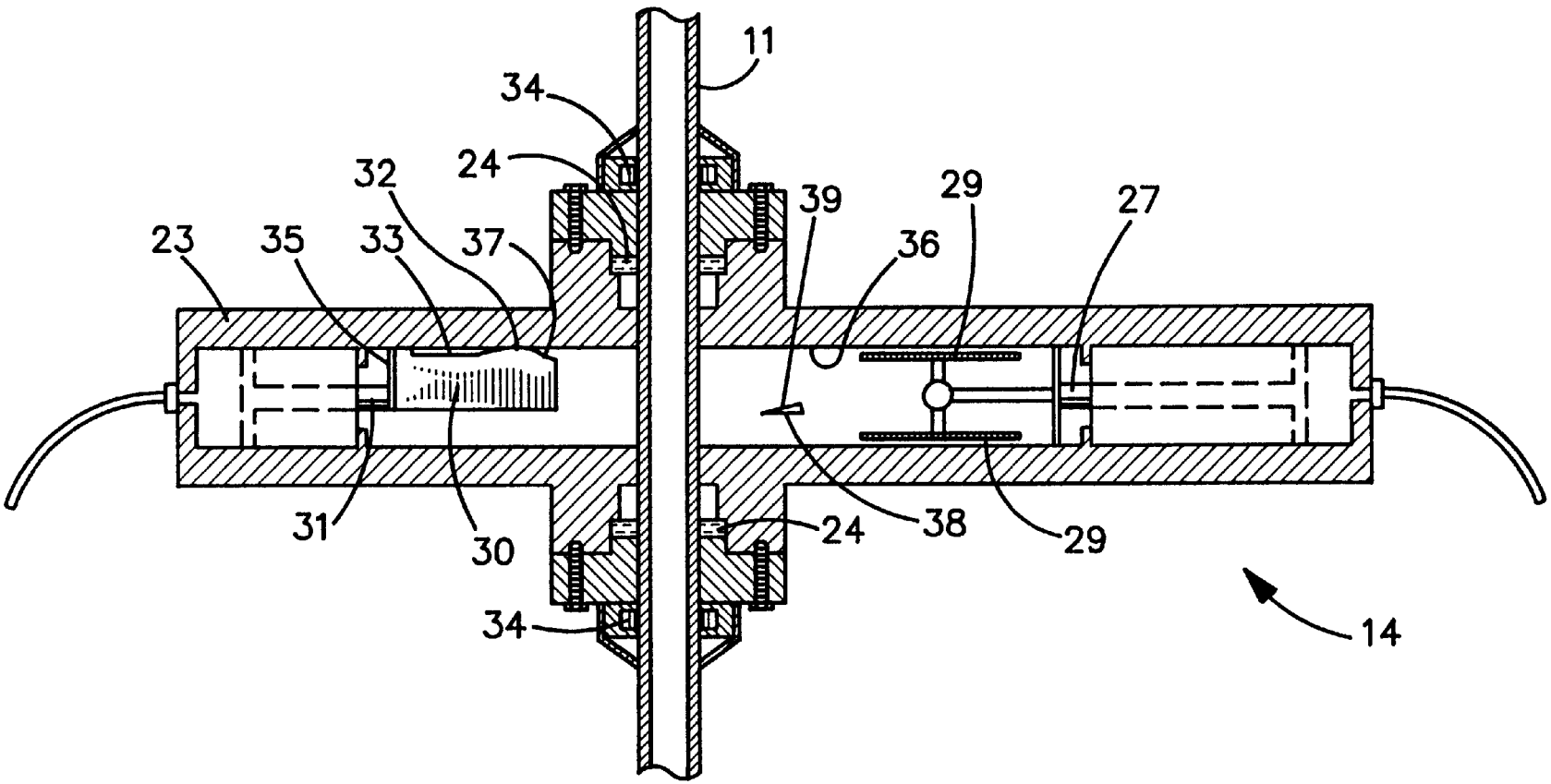
FIG. 6A is a cross-sectional view of a blow out preventer having two hydraulic arms, a pair of rotatable saws, and a block on a production line prior to severance.
Figure 6B:
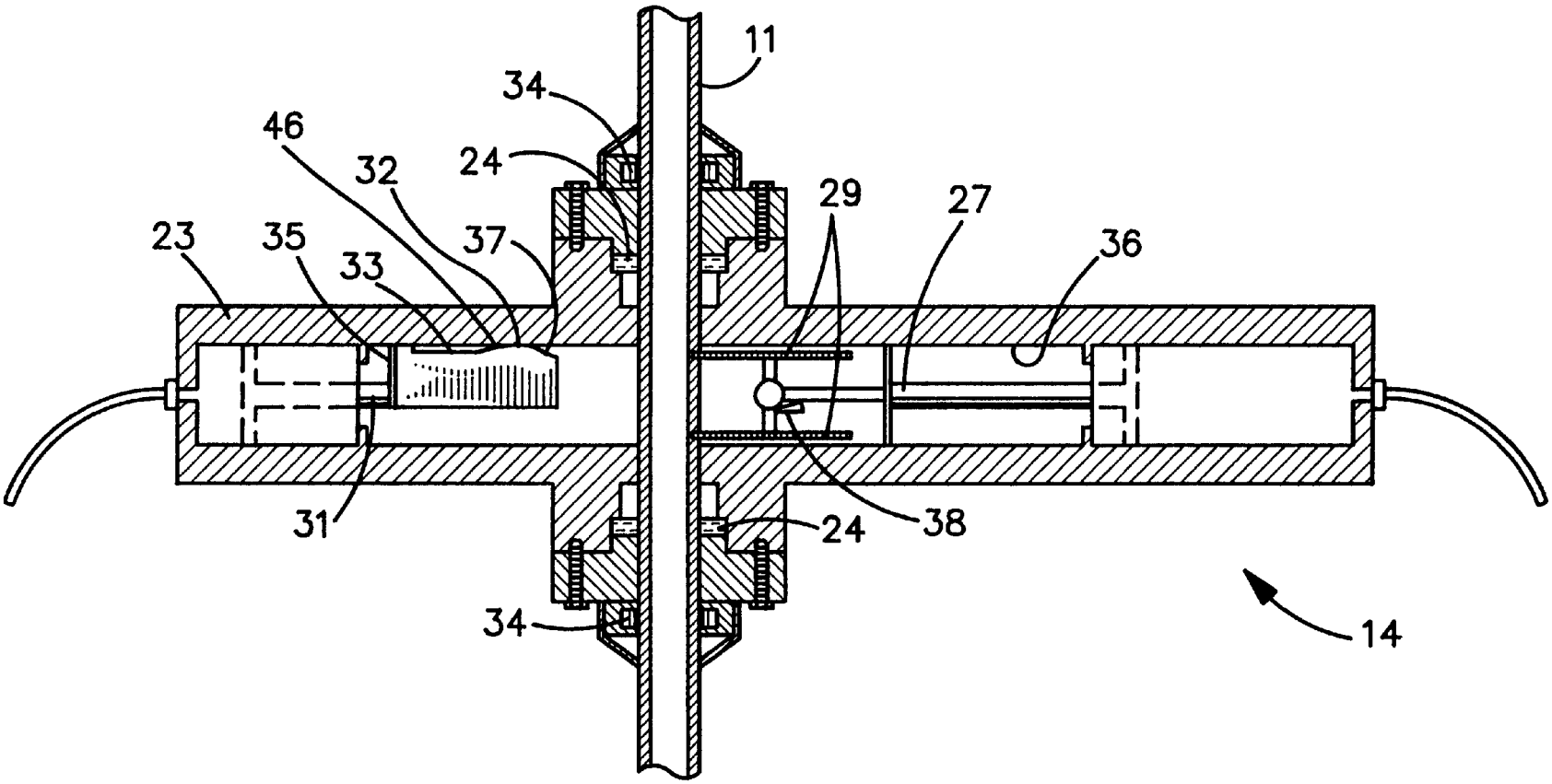
FIG. 6B is a cross-sectional view of a blow out preventer having two hydraulic arms, a pair of rotatable saws, and a block on a production line during use of the rotatable saws to cut grooves into the production line.
Figure 6C:
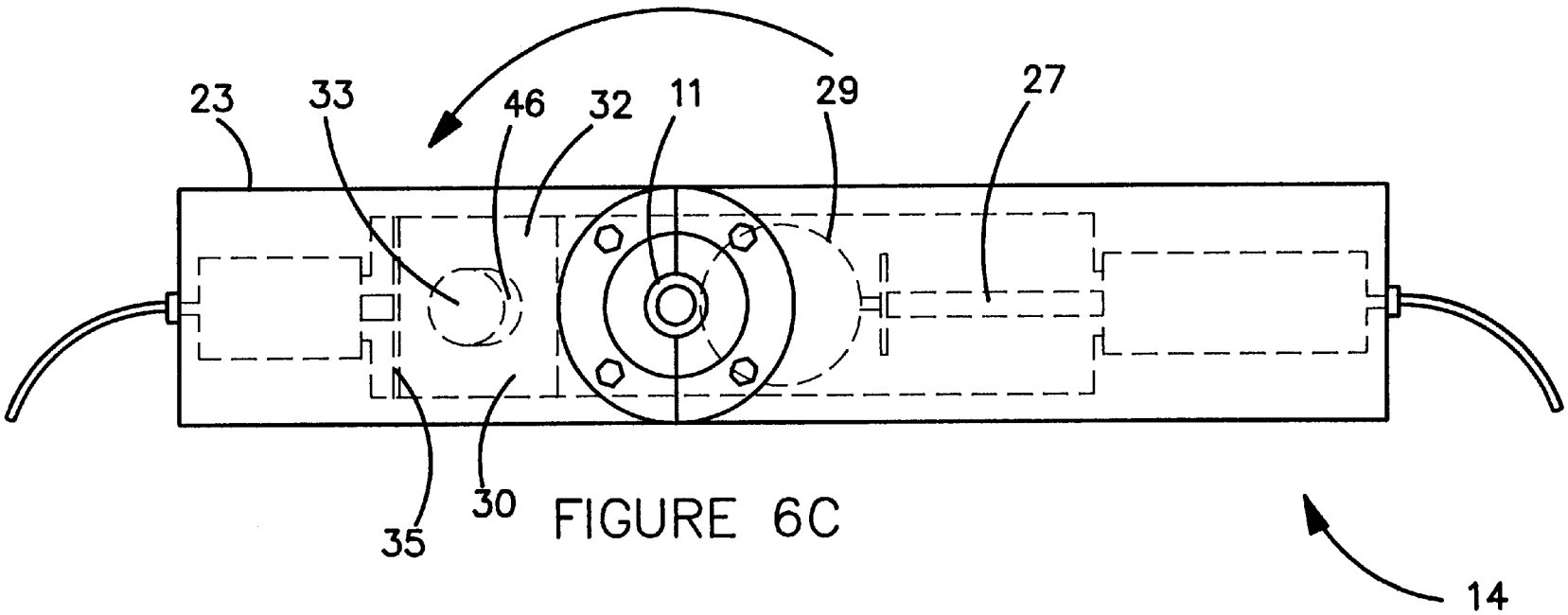
FIG. 6C is a top view of a blow out preventer having two hydraulic arms, a pair of rotatable saws, and a block on a production line during use of the rotatable saws to cut grooves into the production line, illustrating the rotation of the saws around the production line.
Figure 6D:
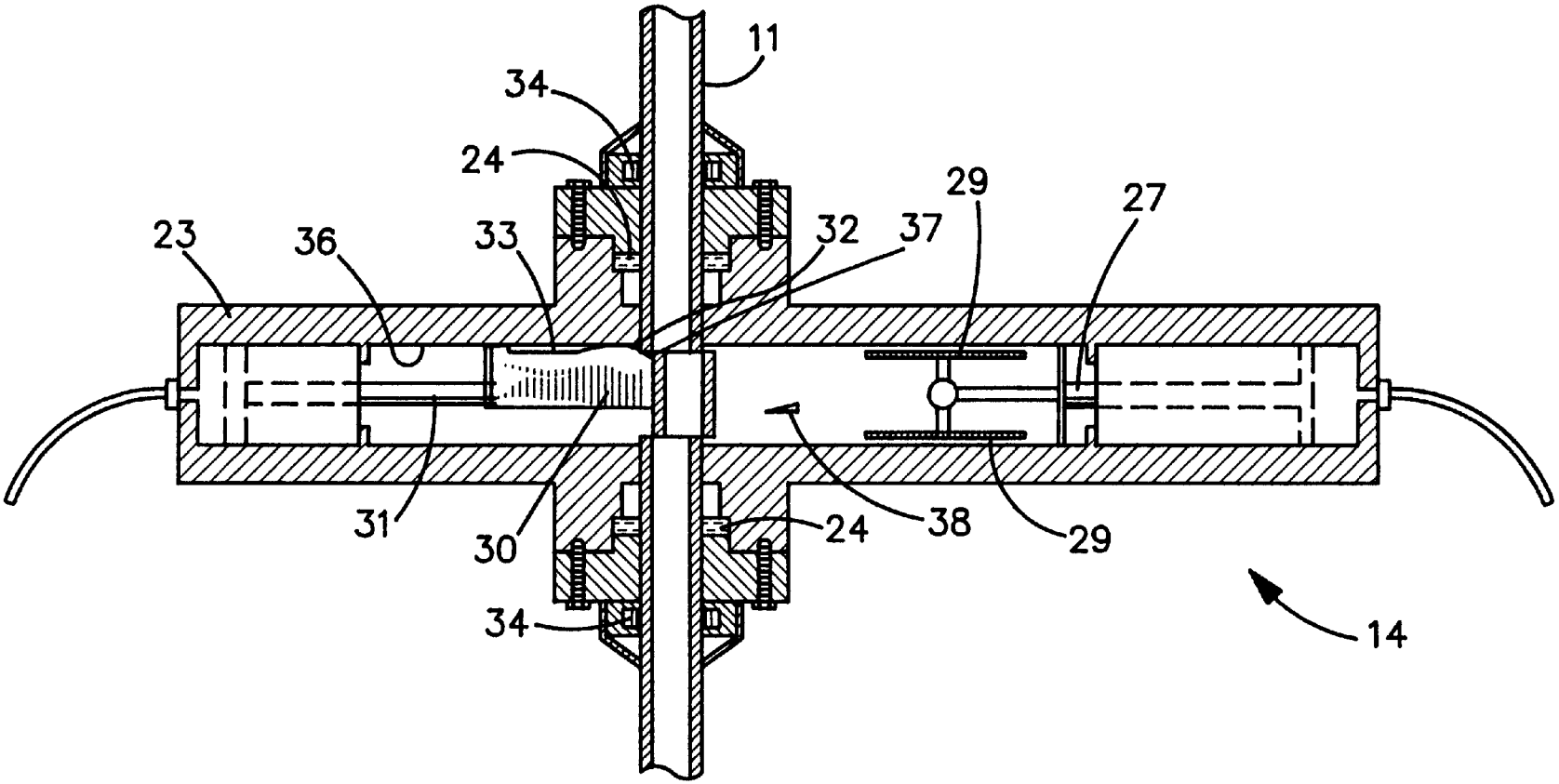
FIG. 6D is a cross-sectional view of a blow out preventer having two hydraulic arms, a pair of rotatable saws, and a block on a production line with the production line closed by the block.

Blow out preventer 14 comprises a housing 23 having two sections. Housing 23 is configured to sealingly mount over production line 11 preferably as illustrated in FIG. 5C. When the sections of housing 23 are joined, preferably by bolting and/or welding the sections together, a tight seal is formed between housing 23 and production line 11, preferably through use of packing glands 24, typically comprising a plurality of rubber rings circumferentially located about production line 11 which upon compression expand into tight contact with production line 11. In addition to or instead of packing glands 24, housing 23 may be welded to production line 11 to create a seal. A ring type gasket (not shown) should preferably be provided between the sections of housing 23 in order to facilitate the formation of a tight seal. Preferably, this gasket will be metal and most preferably steel. Housing 23 and the seals between housing 23 and production line 11 and between the sections of housing 23 must be designed to withstand the full pressure of the well feeding production line 11. This can often exceed 10,000 psi.

Once housing 23 is in place, production line 11 is ready to be closed. This is done by first severing production line 11. Housing 23 may be provided with one of several cutting means 25. One cutting means 25 is a shear 26 mounted upon a hydraulic arm 27. Shear 26 preferably includes two blades 28 separated by several inches. Hydraulic arm 27 will advance shear 26 through production line 11, severing it. The use of two blades 28 will allow a section of production line 11 to be removed.

In another preferred embodiment, cutting means 25 comprises a pair of saws 29 mounted on hydraulic arm 27. Saws 29 are preferably driven by a hydraulic motor (not shown). Saws 29 are preferably separated by several inches. Hydraulic arm 27 will advance saws 29 through production line 11, severing it. The use of two saws 29 will allow a section of production line 11 to be removed.

In another preferred embodiment, cutting means 25 comprises a pair of saws 29 mounted on hydraulic arm 27. Hydraulic arm 27 is configured to advance saws 29 through one wall of production line 11, but not to completely sever production line 11. Hydraulic arm 27 and saws 29 are then rotated around production line 11, severing it. Again, the use of two saws allows a section of production line 11 to be removed.

Hydraulic arm 27 and saws 29 may be rendered rotatable by mounting housing 23 on bearings 34, such as a tapered Tempkin bearing. The entire housing 23 may be rotated about production line 11 in this embodiment. This rotation may be facilitated by attaching housing 23 to the production line preferable at a point above and below the upper and lower bearings 34, respectively. Bearings 34 should be able to withstand the same pressure requirements as the rest of housing 23.

In another preferred embodiment, cutting means 25 comprises a pair of saws 29 mounted on hydraulic arm 27. Hydraulic arm 27 is configured to advance saws 29 into but not through one wall of production line 11. Hydraulic arm 27 and saws 29 are then rotated around production line 11, creating a pair of parallel circumferential grooves in production line 11.

It may be desirable to pressurize housing 23 with an inert gas prior to severing production line 11, in order to minimize the possibility of igniting the petroleum stream. This may be accomplished through a valve that may be provided in housing 23.

After cutting means 25 has been employed on production line 11, production line 11 is closed with a block 30 typically mounted on a second hydraulic arm 31. Block 30 should be mounted on second hydraulic arm 31 to be vertically slidable relative to second hydraulic arm 31. Preferably, this is accomplished by mounting block 30 on a "crevace" 35 which provides free vertical movement relative to second hydraulic arm 31. Block 30 should be thinner than the section of production line 11 removed by cutting means 25, so that extension of second hydraulic arm 31 may extend block 30 into the void left in production line 11. Second hydraulic arm 31 should be positioned so that block 30 will contact the upper surface 36 of housing 23 at or before block 30 reaches its highest vertical position relative to second hydraulic arm 31.

After production line 11 is severed, the petroleum or other fluid in production line 11 will escape into housing 23. Housing 23 and its seals with production line 11 must, therefore, be sufficient to withstand the pressure driving production line 11, often 10,000 psi or more. The well pressure will force the petroleum into the platform end of severed production line 11, maintaining flow through production line 11.

The well pressure of production line 11 will also drive block 30 to its highest vertical position relative to second hydraulic arm 31. If production line 11 is not severed flush with upper surface 36, block 30 will encounter production line 11 when block 30 is extended. Continued extension of second hydraulic arm 31 may crimp the platform end of severed production line 11. Although some deformation of production line 11 is acceptable, it is preferable that deformation be minimized so that the carrying capacity of production line 11 will not be diminished.

To prevent deformation of production line 11, block 30 may be configured to slide downward upon contact with production line 11. Preferably, this is done by beveling the upper leading edge 37 of block 30. When beveled leading edge 37 contacts production line 11, continued extension of second hydraulic arm 31 will force block 30 downward until upper surface 32 of block 30 is below the platform end of severed production line 11. Block 30 may then extend without substantial deformation of production line 11.

Block 30 may be configured to create a fluid tight seal with production line 11; however, block 30 is preferably designed to seal with upper surface 36 of housing 23 around severed production line 11. When production line 11 is not severed substantially flush with upper surface 36, production line 11 may prevent block 30 from engaging upper surface 36.

Therefore, upper surface 32 of block 30 is preferably provided with a depression 33 sized to receive the severed end of production line 11. When block 30 is positioned so that depression 33 is positioned over production line 11, the well pressure will drive block 30 upward until it contacts upper surface 36 of housing 23. Depression 33 should be sufficiently deep to prevent severed production line 11 from interfering with the connection between block 30 and upper surface 36 of housing 23.

In a preferred embodiment, housing 23 is provided with a seating wedge 38. Seating wedge 38 should have a beveled edge 39 positioned opposite block 30. Seating wedge beveled edge 39 should be positioned so that the lower leading edge 40 of block 30 will encounter seating wedge beveled edge 39 as it is extended. Seating wedge beveled edge 39 should be angled so that extension of block 30 drives block 30 upward into contact with upper surface 36 of housing 23. Seating wedge 38, second hydraulic arm 31, block 30 and depression 33 are preferably positioned relative to one another so that when hydraulic arm 31 is fully extended, seating wedge 38 will have driven block 30 into tight contact with upper surface 36 and the platform end of severed production line 11 will be contained within depression 33. In this position, block 30 will prevent fluid passage into the platform end of severed production line 11, thereby preventing further flow to the surface. In a more preferred embodiment upper surface 32 of block 30 is provided with a rubber gasket or a rubber coating to facilitate the formation of a seal with upper surface 36 of housing 23.

In the embodiment described above, wherein said cutting means 25 only creates parallel grooves in production line 11, block 30 may be used to sever production line 11. Block 30 is brought into contact with production line 11 between the parallel grooves. Continued exertion of force by second hydraulic arm 31 will displace a section of production line 11 between the parallel grooves. In another preferred embodiment, block 30 is provided with an attachment below and extending in front of block 30. In this embodiment, the attachment will encounter production line 11 and displace a section thereof, as block 30 is extended. Block 30, using beveled upper leading edge 37, would be driven below the platform end of severed production line 11 and then used to close production line 11 as described above.

Second hydraulic arm 31 may be eliminated when shear 26 embodiment of cutting means 25 is utilized. In this embodiment, block 30 may be located between shears 26 and hydraulic arm 27. Block 30 should preferably be slidably mounted to hydraulic arm 27 as described above. If production line 11 is sheared substantially flush with upper surface 36 of housing 23, upper surface 32 of block 30 and shears 26 may be substantially aligned. Hydraulic arm 27 will extend block 30 until it is positioned over the platform end of severed production line 11. The pressure from the well will drive block 30 into tight contact with upper surface 36 of housing 23. Additionally, seating wedge 39 may be positioned to engage shears 26 so that continued advancement of hydraulic arm 27 will drive block 30 into tight contact with upper surface 36 of housing 23. Preferably, block 30 is provided with depression 33 in this embodiment so that any protrusions that may extend from severed production line 11 will not interfere with the formation of a seal between block 30 and upper surface 36 of housing 23.

If production line 11 is not severed substantially flush with upper surface 36 of housing 23, a different connection between shears 26 and block 30 is preferred. As before, block 30 would be slidably mounted to hydraulic arm 27; however the upper surfaces 32 and 41 of shears 26 and block 30 would not be substantially aligned. Shears 26 should be wider than block 30. Shears 26 should also be attached to block 30 so that shears 26 are lower than block 30 relative to hydraulic arm 27. The upper connecting surface 42 between block 30 and shears 26 should be beveled so that when shears 26 have passed through production line 11, the platform end of severed production line 11 will contact upper connecting surface 42. The beveling of upper connecting surface 42 will drive block 30 and shears 26 downward as hydraulic arm 27 is extended until upper surface 32 of block 30 is below the platform end of severed production line 11.

In order to facilitate the downward movement of shears 26 and block 30, shears 26 and block 30 should be configured to minimize contact between shears 26 and block 30 and the well end of severed production line 11 as hydraulic arm 27 is extended. In one such preferred configuration, the lower connecting surface 43 between the lower surfaces 44 and 45 of shears 26 and block 30 will comprise a steep upward angle from shears 26 to block 30. Lower surface 45 of block 30 would, therefore, be higher than lower surface 44 of shears 26 relative to hydraulic arm 27. The distance between lower surface 44 of shears 26 and lower surface 45 of block 30 should be at least as great as and preferably greater than the distance between upper surface 41 of shears 26 and upper surface 32 of block 30. The end of lower connecting surface 43 closest to hydraulic arm 27 should preferably terminate at least a distance equal to the diameter of production line 11 before the end of upper connecting surface 42 closest to shears 26 begins. In this configuration, block 30 and shears 26 could move downward upon the interaction of beveled upper connecting surface 42 with the platform end of severed production line 11 without shears 26 or block 30 contacting the well end of severed production line 11.

In this embodiment, block 30 is preferably provided with depression 33 substantially as described above. When the extension of hydraulic arm 27 positions depression 33 over the platform end of severed production line 11, the well pressure and/or seating wedge 38 will drive block 30 into tight contact with upper surface 36 of housing 23. As described above, block 30 will form a fluid tight seal with upper surface 36 of housing 23 which will prevent further flow through production line 11.

When the surface fires have been extinguished, and the well is ready to be returned to production, block 30 can be retracted by operation of the hydraulic arm 27 or 31 on which it is mounted. To facilitate the retraction of block 30, the edge of depression 33 opposite hydraulic arm 27 or second hydraulic arm 31, whichever block 30 is attached to, should preferably be beveled. When hydraulic arm 27 or 31 is retracted, beveled edge 46 of depression 33 will contact the platform end of severed production line 11. Interaction between beveled edge 46 of depression 33 and severed production line 11 will drive block 30 downward until severed production line 11 has been removed from depression 33. Block 30 may then be retracted until it is no longer blocking flow into production line 11. This will allow the petroleum to flow through production line 11 to the surface.

Before work vessel 1 is removed, any casing and grout that was removed should be repaired. This is done by welding casing sections to the old casing and housing 23. The spaces are then filled with grout. When the grout has hardened, work vessel 1 may be removed. Housing 23 is left in place, and may be used to close production line 11 again in the future if needed.

Although the invention is described in the context of the casing and production line associated with an offshore petroleum platform, it is anticipated that the invention may be used with any underwater piping. It is anticipated that these and other uses and embodiments will be obvious to those skilled in the art and are intended to be, covered by the scope of the following claims.

I claim:

1. A blow out preventer for releasably closing a pressurized pipe comprising:

a housing configured to sealingly engage said pressurized pipe, said housing further configured to withstand the pressures within said pipe when said housing has engaged said pipe;

a cutting means for removing a section of said pressurized pipe comprising a pair of shears;

a first hydraulic arm positioned within said housing, said first hydraulic arm functionally connected to said cutting means, said first hydraulic arm and said cutting means configured to extend said cutting means into functional engagement with said pressurized pipe upon operation of said first hydraulic arm;

a block sized to close said pressurized pipe to fluid passage after said section of pressurized pipe has been removed; and a means for positioning said block to close said pressurized pipe to fluid passage after said section of said pressurized pipe has been removed.

2. A blow out preventer according to claim 1 wherein said means for positioning said block to close said pressurized pipe to fluid passage after a section of said pressurized pipe has been removed comprises said block, said first hydraulic arm and said cutting means, said block positioned between said cutting means and said first hydraulic arm.

3. A blow out preventer according to claim 2 wherein said block is vertically slidable relative to said hydraulic arm.

4. A blow out preventer according to claim 3 wherein said block has a beveled upper leading edge, said block configured to slide vertically downward upon contact between said beveled upper edge and an end of said pressurized pipe after said section of said pressurized pipe has been removed.

5. A blow out preventer for releasably closing a pressurized pipe comprising:

a housing configured to sealingly engage said pressurized pipe, said housing further configured to withstand the pressures within said pipe when said housing has engaged said pipe;

a cutting means for removing a section of said pressurized pipe comprising a pair of saws;

a first hydraulic arm positioned within said housing, said first hydraulic arm functionally connected to said cutting means, said first hydraulic arm configured to extend said saws through said pressurized pipe upon operation of said first hydraulic arm;

a block sized to close said pressurized pipe to fluid passage after said section of pressurized pipe has been removed; and a means for positioning said block to close said pressurized pipe to fluid passage after said section of said pressurized pipe has been removed.

6. A blow out preventer according to claim 5 wherein said means for positioning said block to close fluid passage through said pressurized pipe comprises a second hydraulic arm positioned within said housing, said second hydraulic arm configured to extend perpendicularly toward said pressurized pipe.

7. A blow out preventer according to claim 6 wherein said block is vertically slidable relative to said second hydraulic arm.

8. A blow out preventer according to claim 7 wherein said block has a beveled upper leading edge, said block configured to slide vertically downward upon contact between said beveled upper edge and an end of said pressurized pipe after said section of said pressurized pipe has been removed.

9. A blow out preventer for releasably closing a pressurized pipe comprising:

a housing configured to sealingly engage said pressurized pipe, said housing further configured to withstand the pressures within said pipe when said housing has engaged said pipe;

a cutting means for removing a section of said pressurized pipe comprising a pair of saws;

a first hydraulic arm positioned within said housing, said first hydraulic arm functionally connected to said cutting means, said first hydraulic arm configured to extend said saws through at least one wall of said pressurized pipe upon operation of said first hydraulic arm, said first hydraulic arm and said saws further configured to be rotatable about said pressurized pipe;

a block sized to close said pressurized pipe to fluid passage after said section of pressurized pipe has been removed; and a means for positioning said block to close said pressurized pipe to fluid passage after said section of said pressurized pipe has been removed.

10. A blow out preventer according to claim 9 wherein said means for positioning said block to close fluid passage through said pressurized pipe comprises a second hydraulic arm positioned within said housing, said second hydraulic arm configured to extend perpendicularly toward said pressurized pipe.

11. A blow out preventer according to claim 10 wherein said block is vertically slidable relative to said second hydraulic arm.

12. A blow out preventer according to claim 11 wherein said block has a beveled upper leading edge, said block configured to slide vertically downward upon contact between said beveled upper edge and an end of said pressurized pipe after said section of said pressurized pipe has been removed.

13. A blow out preventer for releasably closing a pressurized pipe comprising:

a housing configured to sealingly engage said pressurized pipe, said housing further configured to withstand the pressures within said pipe when said housing has engaged said pipe;

a cutting means comprising a pair of saws;

a first hydraulic arm positioned within said housing, said first hydraulic arm functionally connected to said cutting means, said first hydraulic arm configured to extend said saws into said walls of said pressurized pipe upon operation of said first hydraulic arm, said first hydraulic arm and said saws further configured to be rotatable about said pressurized pipe whereby a pair of substantially parallel grooves may be cut into said pressurized pipe;

a block sized to close said pressurized pipe to fluid passage after a section of pressurized pipe has been removed;

a second hydraulic arm positioned within said housing, said block functionally connected to said second hydraulic arm, said second hydraulic arm and said block configured to engage said pressurized pipe between said substantially parallel grooves upon operation of said second hydraulic arm, whereby operation of said second hydraulic arm will remove the section of said pressurized pipe between said parallel grooves and a means for positioning said block to close said pressurized pipe to fluid passage after said section of said pressurized pipe has been removed.

14. A blow out preventer according to claim 13 wherein said block is vertically slidable relative to said second hydraulic arm.

15. A blow out preventer according to claim 13 wherein said block has a beveled upper leading edge, said block configured to slide vertically downward upon contact between said beveled upper edge and an end of said pressurized pipe after said section of said pressurized pipe has been removed.

16. A blow out preventer according to claims 1, 2, 3, 4, 5, 6, 7, 8, 9, 10, 11, 12, 13, 14 or 15 further comprising a means for restoring said pressurized pipe to fluid passage.

17. A blow out preventer according to claim 16 wherein said means for restoring said pressurized pipe to fluid passage comprises said first or second hydraulic arm being retractable.

* * * * *